US007021712B2

(12) United States Patent
Spendlove et al.

(10) Patent No.: US 7,021,712 B2
(45) Date of Patent: Apr. 4, 2006

(54) CHAIR WITH FLEXIBLE, RESILIENT BACK SUPPORT

(75) Inventors: Dale Spendlove, Orem, UT (US); Louis N. Hardy, Pleasant Grove, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 10/870,710

(22) Filed: Jun. 16, 2004

(65) Prior Publication Data

US 2005/0001462 A1 Jan. 6, 2005

Related U.S. Application Data

(62) Division of application No. 10/213,602, filed on Aug. 6, 2002, now Pat. No. 6,779,846.

(51) Int. Cl.
*A47C 7/44* (2006.01)

(52) U.S. Cl. ..... 297/285; 297/297; 297/301.1

(58) Field of Classification Search ..... 297/296–299, 297/301.1, 301.6, 301.7, 301.3, 285; 403/220, 403/223, 291, 292; 298/160
See application file for complete search history.

(56) References Cited

U.S. PATENT DOCUMENTS

| | | | | |
|---|---|---|---|---|
| 3,057,660 | A | 10/1962 | Schneider | |
| 3,712,666 | A | 1/1973 | Stoll | |
| 4,451,085 | A | 5/1984 | Franck et al. | |
| 4,498,702 | A | 2/1985 | Raftery | |
| 4,549,764 | A | 10/1985 | Haedo | |
| 4,557,521 | A | 12/1985 | Lange | |
| 4,580,836 | A | 4/1986 | Verney | |
| 4,585,272 | A | 4/1986 | Ballarini | |
| 4,603,904 | A | 8/1986 | Tolleson et al. | |
| 4,756,575 | A | 7/1988 | Dicks | |
| 4,790,595 | A | 12/1988 | Hensel et al. | |
| 4,869,552 | A | 9/1989 | Tolleson et al. | |
| 4,913,493 | A | 4/1990 | Heidmann | |
| 5,039,163 | A | 8/1991 | Tolleson | |
| 5,108,149 | A | 4/1992 | Ambasz | |
| 5,871,258 | A | 2/1999 | Battey et al. | |
| 5,887,946 | A | 3/1999 | Raftery | |
| 5,902,012 | A | 5/1999 | Han | |
| 5,904,397 | A | 5/1999 | Fismen | |
| 5,975,634 | A | 11/1999 | Knoblock et al. | |
| 5,988,746 | A | 11/1999 | Raftery | |
| 6,065,803 | A | 5/2000 | Li et al. | |
| 6,349,992 | B1 | 2/2002 | Knoblock et al. | |
| 6,406,096 | B1 * | 6/2002 | Barile, Sr. | 297/301.3 |
| 6,471,293 | B1 * | 10/2002 | Ware et al. | 297/301.1 |
| 6,533,352 | B1 * | 3/2003 | Glass et al. | 297/299 |
| 6,779,846 | B1 | 8/2004 | Spendlove et al. | |
| 2002/0117883 | A1 * | 8/2002 | Gevaert | 297/291 |

* cited by examiner

*Primary Examiner*—Peter R. Brown
(74) *Attorney, Agent, or Firm*—Thorpe North & Western

(57) ABSTRACT

A chair with a flexible resilient back support structure includes a hollow tubular seat frame, a hollow tubular backrest frame pivotally connected to the seat frame, and a limit stop affixed to the backrest frame or the seat frame adjacent to the pivot points. The limit stop is configured to limit a degree of rotation of the backrest frame between an upright position and a maximum backwardly rotated position. An elongate spring element extends from within the backrest frame into the seat frame, and is configured to bias the backrest frame in the upright position, and to resiliently resist backward rotation. In various embodiments, a cam surface is associated with the spring element, providing an effective fulcrum point which moves rearwardly as the backrest frame reclines, thereby increasing the effective flexural resistance of the spring element during reclining.

18 Claims, 5 Drawing Sheets

CHAIR WITH FLEXIBLE, RESILIENT BACK SUPPORT

CROSS REFERENCE TO RELATED APPLICATION(S)

This is a Division of application Ser. No. 10/213,602, filed on Aug. 6, 2002, now U.S. Pat. No. 6,779,846.

BACKGROUND OF THE INVENTION

1. Field of the Invention

The present invention relates generally to chairs with flexible backrests. More particularly, the present invention relates to a chair having a back support structure that is resiliently hingedly coupled to the seat and supporting structure.

2. Related Art

Reclining chairs are generally considered more comfortable than non-reclining chairs. Of the variety of reclining chairs, some comprise a chair with a fixed seat and a backrest that is configured to flex or recline backward relative to the seat. There are a variety of types of chairs with flexible or reclining backrests. Some of these involve very complicated reclining mechanisms. Some involve flexible members that bend along their length, while others include relatively rigid frame components that are hingedly coupled together in various locations.

Unfortunately, many of the reclining mechanisms that have been developed are not suitable to simple, relatively low-cost chairs, such as stackable banquet or meeting hall chairs. A bulky reclining mechanism is not suitable for stackable chairs, and an expensive mechanism is not desirable for locations such as hotels and the like, which require large numbers of chairs for banquets, conferences, etc.

Another problem with some simple reclining back chairs is the location where the chair reclines or bends. To be comfortable, a reclining chair should bend in a location that corresponds as closely as possible to the motion of the human body. Some flex-back chairs bend in places that actually make reclining less comfortable, and others merely tip back, without actually reclining. Both of these motions do not adequately address the structure and motion of the human body.

Additionally, some reclining mechanisms, particularly the more simple ones, present pinch points where a user's fingers or other items can get caught. While there are various methods that have been devised for reducing, or hiding pinch points, many prior solutions have not adequately addressed the problem in an effective and inexpensive manner.

SUMMARY OF THE INVENTION

The present invention advantageously provides a chair having a hollow tubular seat frame, a hollow tubular backrest frame pivotally connected to the seat frame at fixed pivot points, a limit stop, affixed to the backrest frame and the seat frame adjacent to the pivot points, and a substantially solid elongate spring element, extending from within the backrest frame into the seat frame. The limit stop is configured to limit a degree of rotation of the backrest frame relative to the seat frame between an upright position and a maximum backwardly rotated position, and the spring element is configured to bias the backrest frame in the upright position, and to resiliently resist backward rotation of the backrest frame.

In accordance with a more detailed aspect of the present invention, in one embodiment the spring element includes a curved lower surface, providing an effective fulcrum point which moves rearwardly as the backrest frame is rotated backwardly, thereby increasing the effective flexural resistance of the spring element during backward rotation.

Additional features and advantages of the invention will be apparent from the detailed description which follows, taken in conjunction with the accompanying drawings, which together illustrate, by way of example, features of the invention.

DETAILED DESCRIPTION

Figure 1:
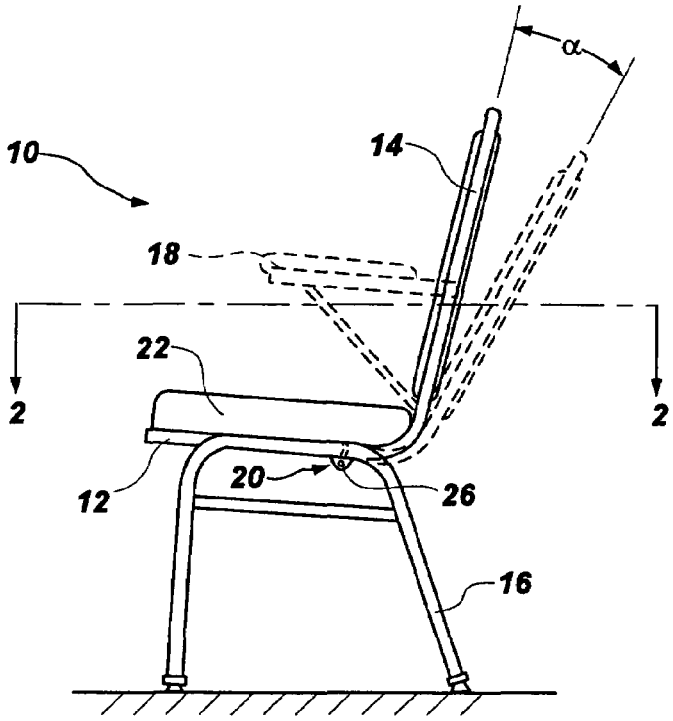
FIG. 1 is a side view of one embodiment of a chair having a flexible, resilient back support structure in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
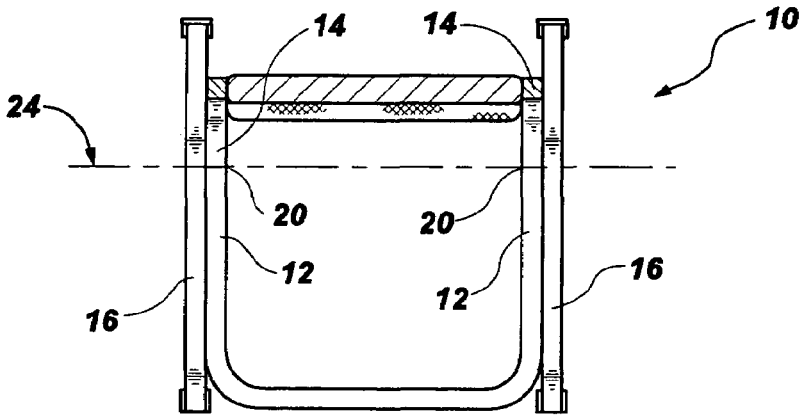
FIG. 2 is a top cross-sectional view of the chair of FIG. 1 with the seat cushion removed.

Referring to FIG. 1 and FIG. 2, the present invention is depicted as applied to a common type of stackable banquet chair 10. It will be apparent, however, that the present invention is also adaptable to many other types of chairs. The chair 10 includes a hollow tubular seat frame 12, and a hollow tubular backrest frame 14. In typical stackable banquet chairs, the backrest frame is an extension of the seat frame, and the seat frame is fixedly attached to chair leg frame members 16, such as by welding along its two sides.

An armrest assembly 18, shown in dashed lines in FIG. 1, may also be rigidly attached to the backrest frame for added comfort.

The present invention improves on the standard chair of this type by providing a resiliently reclining backrest. The backrest frame 14 is pivotally connected to the seat frame with hinges 20 on each side below the seat 22. Rather than the backrest and seat frame being formed of a continuous tubular member, the seat frame 12 and backrest frame 14 are discontinuous but aligned, and are joined by the hinge 20. The pivot point of the hinge is therefore external to the tubular frame, and allows the backrest to rotate about a pivoting axis (24 in FIG. 2) relative to the seat frame, between an upright position, as shown in solid lines in FIG. 1, and a maximum backwardly rotated position, shown in dashed lines in FIG. 1. In one embodiment of the invention, the maximum backwardly rotated position is at an angle $\alpha$ of about 13.5° relative to the upright position. It will be apparent, however, that other angles could also be used.

Advantageously, the hinged connection 20 is disposed below the chair seat 22, so that mating ends of the respective tubular frame members are mostly hidden from view and from access. It will be apparent that in the region of a hinge, there is the possibility of creating a pinch point wherein fingers and other objects could get squeezed in the hinge when it closes. By locating the hinge below the seat, the top and outer side of the hinge mechanism are completely covered. The only exposed portions of the hinge are the bottom, where the hinge pin 26 is located (thus not presenting a pinch point) and the inner side of it (i.e. the side toward the center of the chair). By virtue of its inner location, this side of the hinge presents a substantially limited chance of coming into contact with fingers and other objects. Additionally, the design of the limit stop and spring elements as described below also helps to reduce the likelihood and seriousness of any pinching.

Figure 3:
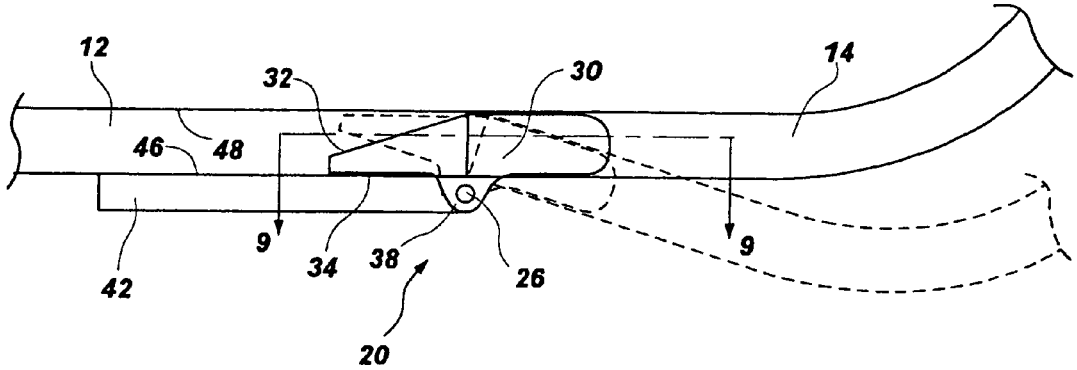
FIG. 3 is a side, cross-sectional view of the flexible joint of the chair of FIG. 1 showing one embodiment of an internal limit stop.
Figure 4:
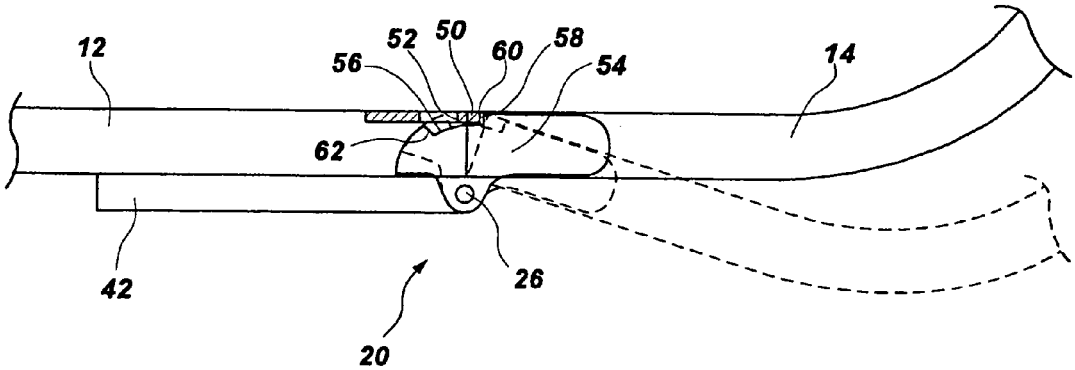
FIG. 4 is a side, cross-sectional view of the flexible joint of the chair of FIG. 1 having an alternative embodiment of an internal limit stop.
Figure 5:
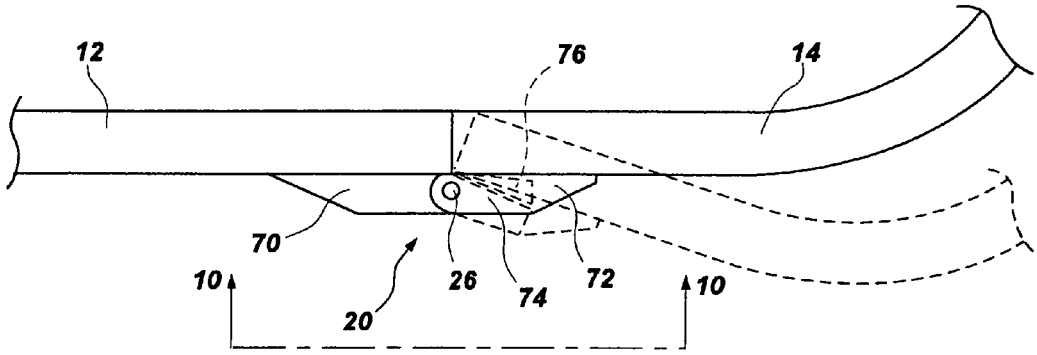
FIG. 5 is a side, cross-sectional view of the flexible joint of the chair of FIG. 1 having an external limit stop.
Figure 6:
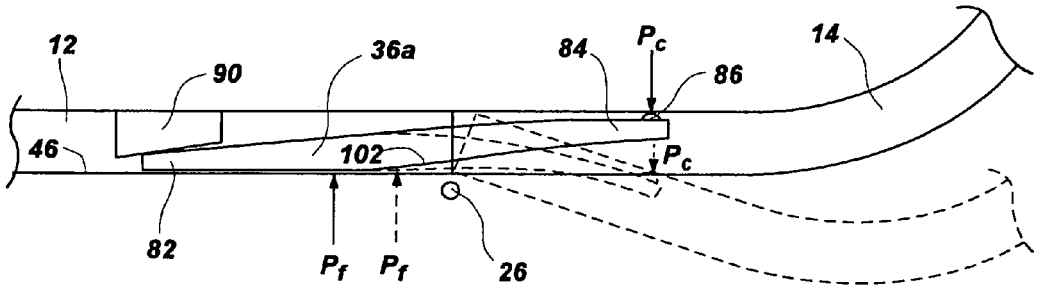
FIG. 6 is a side, cross-sectional view of the flexible joint of the chair of FIG. 1, wherein the spring member is maintained in place with a wedge.

The chair 10 includes limit stops to limit the degree of rotation $\alpha$ of the backrest frame 14, and a resilient spring member for (i) biasing the backrest in the upright position, and (ii) resiliently resisting reclining. The limit stops may be configured in a variety of ways, three embodiments of which are shown in FIGS. 3–5. The embodiments shown in FIGS. 3 and 4 are internal to the tubular frame members. That shown in FIG. 6 is an external limit stop, being affixed to the outside of the tubular frame members.

Figure 9:
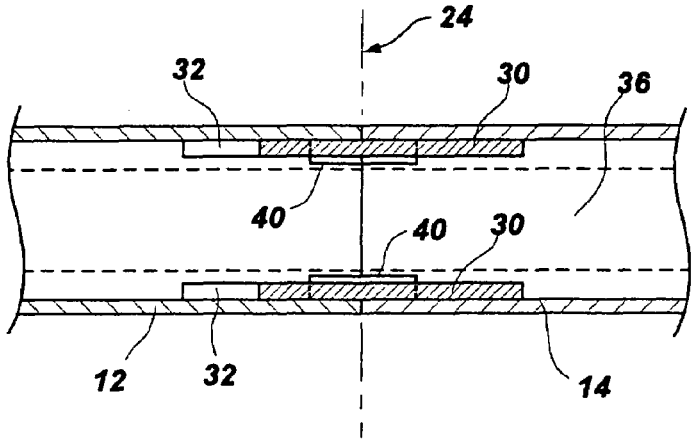
FIG. 9 is a cross-sectional view of the of FIG. 3, looking downward, showing the stop plates disposed inside the tubular frame members.

The limit stop depicted in FIGS. 3 and 9 comprises a stop plate 30, which is affixed within the backrest frame 14 and extends into the seat frame 12. The stop plate is vertically oriented, and has an upper, sloped stop surface 32, and a lower surface 34. In practice, in the embodiments of FIG. 3 and FIG. 4, two stop plates are used, one against each inner side of the respective tubes. The orientation of these two parallel plates are more clearly shown in the cross-sectional view of FIG. 9. The space between the plates is open for passage of the spring element 36, as more fully described below. The stop plates 30 include a hinge loop 38 which extends below the frame through corresponding slots 40 in the ends of each tube. The two opposing hinge loops function as the female portion of the hinge 20. A stiffener 42 is attached (i.e. welded) to the seat frame adjacent the hinge, and includes a corresponding hinge loop (not shown) that fits between the hinge loops of the stop plates, serving as the male portion of the hinge. With the hinge loops of the stop plates and stiffener aligned, the hinge pin 26 is inserted therethrough to join the backrest frame to the seat frame and create the external pivot point.

The lower surface 34 of the stop plate 30 is configured to abut the lower inside surface 46 of the tubular seat frame member 12 when the backrest 14 is in the upright position. Because the stop plate is attached to the backrest frame, it rotates with the backrest frame such that its sloped stop surface 32 abuts the upper inner surface 48 of the hollow seat frame member when the backrest is in the fully reclined position, as shown in dashed lines in FIG. 3.

It will be apparent that the stop plates 30 could alternatively be affixed within the seat frame 12 (rather than the backrest frame) and extend into the backrest frame 14 (rather than the seat frame), and still perform in a similar manner. In such a situation, the upper and lower surfaces 32 and 34 of the limit stops would press against the upper and lower surfaces of the backrest frame when in the reclined and upright positions, respectively.

The limit stop can also be configured in other ways. Referring to FIG. 4, the limit stop may comprise a horizontal stop bar 50 extending from the open end of the seat frame tube 12, and having a back side 52. A pair of vertical stop plates 54 (disposed on opposing interior sides of the tubular frame members in a manner similar to the stop plates 30 of FIG. 9) are disposed within the backrest frame and extend into the seat frame, and include a curved, elongate slot 56, which generally surrounds the stop bar 50. The elongate slot includes a forward surface 58 that is configured to abut a front side 60 of the stop bar when the backrest frame 14 is in the upright position, and a rearward stop surface 62 configured to abut the back side 52 of the stop bar when the backrest frame is in the maximum backwardly rotated position, indicated by dashed lines in FIG. 4. It will be apparent that the stop bar 50 could alternatively be affixed within the backrest frame, with the stop plates 54 affixed within the seat frame 12. In the embodiment of FIG. 4, the stop plates also include hinge loops 64 that extend below the tubular frame members, and in conjunction with the stiffener 42, form the hinge 20 in the same manner as the embodiment of FIG. 3.

Figure 10:
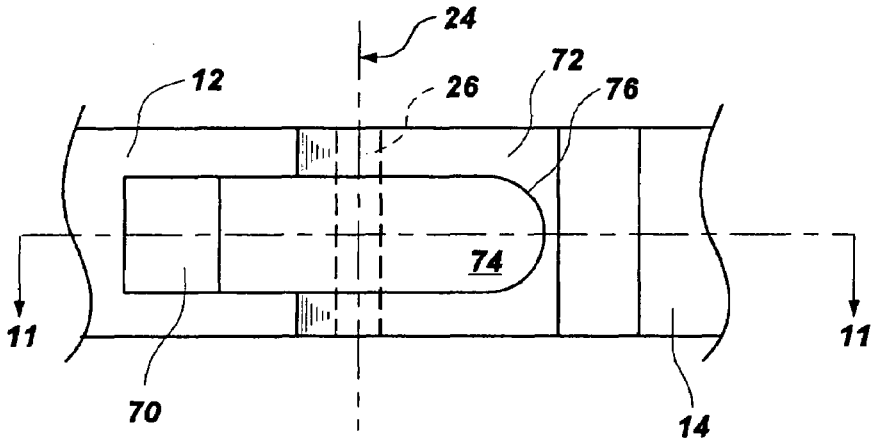
FIG. 10 is a bottom outside view of the external limit stop mechanism of FIG. 5.
Figure 11:
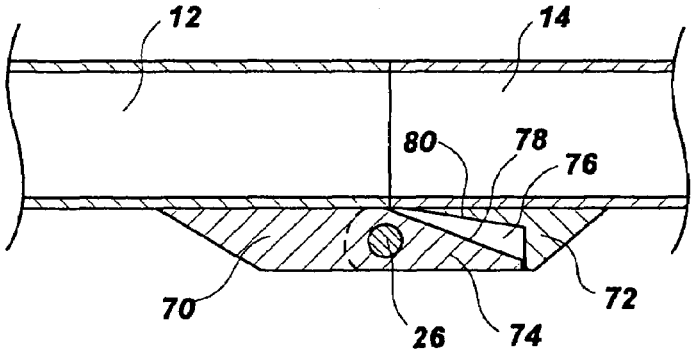
FIG. 11 is a side, cross-sectional view of the external limit stop depicted in FIGS. 5 and 10.

As yet another alternative, the limit stop may be external to the tubular frame. Referring to FIGS. 5, 10, and 11, in an alternative embodiment, the limit stop comprises part of the hinge 20, and is disposed on the outside of the tubular chair frame members. The hinge comprises a first male hinge member 70 affixed to the seat frame 12, and a second female hinge member 72 affixed to the backrest frame 14, with the hinge pin 26 pivotally connecting these two structures along the pivotal axis 24. An extension of the first male hinge member 70 comprises a stop member 74, which fits into a slot 76 formed in the interior of the second female hinge member. The stop member has a sloped stop surface 78, and is configured to rotate into the slot as the backrest is reclined, to eventually reach a position where the stop surface abuts an upper inner surface 80 of the slot when the hinge reaches the maximum rotated position. Between those two positions, rotation is uninhibited. The stop surface mechanically prevents rotation beyond the fully reclined position, which position is determined by the geometry of the stop surface relative to the upper surface of the slot.

One of the advantages of this configuration is that it essentially eliminates any external pinch points. The exposed bottom side of the stop member 74 is flush with the bottom surface of the female hinge member 72 when the backrest 14 is in the upright position, and pivots into the enclosed slot 76 as the backrest frame reclines. Thus there is no way a person can get their fingers disposed between the stop surface 78 and the upper inner surface 80 of the slot, or insert their fingers into a side or edge gap between the moving parts.

It will be apparent that the limit stop mechanism shown in FIGS. 5, 10, and 11 could be configured in different ways and still function equally well. For example, the stop member 74 could be configured to abut an outer surface of one of the tubes, rather than a surface of one of the hinge members. Additionally, the two members of the hinge 20 could be affixed to the tubular frame in an orientation opposite to that shown.

Figure 7:
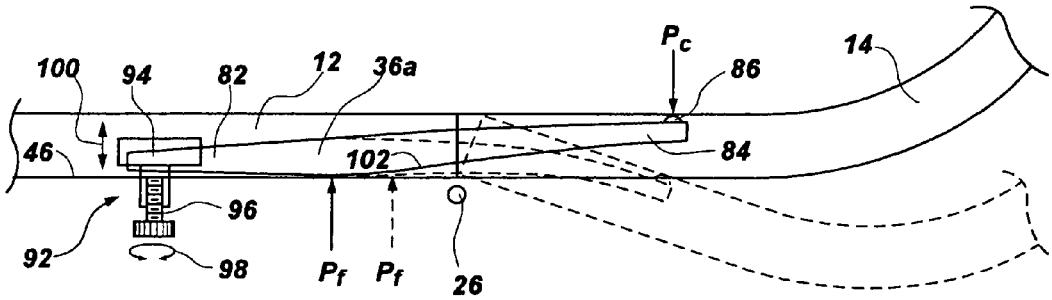
FIG. 7 is a side, cross-sectional view of the flexible joint of the chair of FIG. 1, wherein the spring member is maintained in place with an adjustable hold down member.
Figure 8:
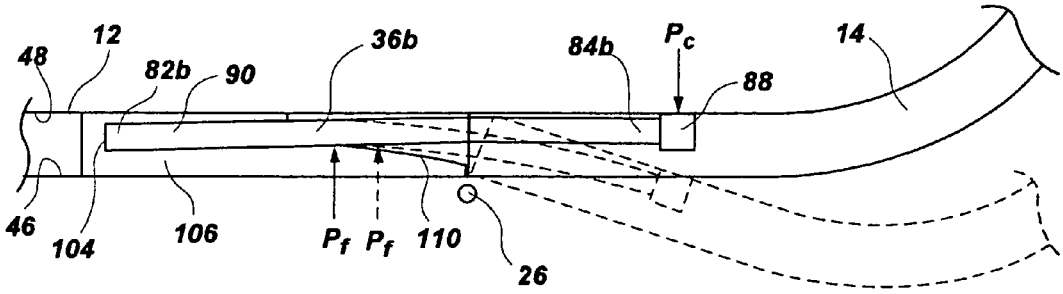
FIG. 8 is a side, cross-sectional view of the flexible joint of the chair of FIG. 1, wherein the spring element is disposed against the upper inner surface of the seat frame member.

Referring to FIGS. 6–8, extending from within each end of the seat frame 12 into the corresponding open end of the backrest frame 14 is a substantially solid elongate spring element 36. The forward end 82 of the spring element is held firmly in place within the seat frame tube, and extends to a point of contact $P_c$ at its rearward end 84 inside the backrest frame. The spring element acts as a cantilever beam, resiliently resisting reclining of the backrest frame from the upright position.

As can be seen from the drawings, the spring element 36 is presumably slightly bent when the backrest 14 is in the upright position. The position and orientation of the spring element is designed such that it is under a certain amount of pre-applied bending stress or pre-load stress when the chair back is in the upright position. This pre-load stress biases the backrest frame in the upright position, and also helps compensate for slight gradual loss of flexural resistance over the life of the spring member.

The spring element 36 may be formed of a variety of materials, including metals and polymers. Suitable polymer materials may include fiber-reinforced composites, ABS plastic, synthetic or natural rubber. One material used by the inventors is extruded fiberglass resin. However, other At the point of contact $P_c$ with the backrest frame 14, the rearward end 84 of the spring element includes a nylon wear button 86, which allows the end of the spring element to smoothly slide against the inside of the tube. Because fiberglass resin is a relatively rough, fibrous material, the inventor has found that where a fiberglass spring element is disposed in direct contact with the inside of the tube, the reclining action can be slightly jerky because of friction between the fiberglass spring element and the steel tube. Nylon provides far less friction, and allows a smoother reclining action. Additionally, the wear button provides an additional measure of pre-load force on the spring element.

Alternatively, an anti-friction end cap 88, shown in FIG. 8, may be placed on the rearward end 84 of the spring element 36 to help reduce friction at the point of contact $P_c$. This configuration also has the advantage that it provides a larger area of contact between the spring element and the inside of the tube, thereby reducing the stress imposed on the tube by the spring element. The inventor has found that with long-term repeated reclining, a wear button 86 can produce a bulge in the tubular frame member at its point of contact. By spreading out the area of contact with an end cap, this deformation is prevented. The nylon button or end cap also provide the advantage of gradually wearing to a more conforming shape, thereby further distributing loads over a larger area.

The spring element 36 may be configured and installed in various ways, as shown in FIGS. 6–8. In the embodiment of FIG. 6, the forward end 82 of the spring element 36*a* is held firmly against the lower inner surface 46 of the seat frame 12 by a wedge 90 that is fixed in place within the tube. Alternatively, as shown in FIG. 7, the forward end of the spring element may be held in place by a hold-down assembly 92, disposed within the hollow seat frame. The hold-down assembly includes a clamp 94, which is attached to the forward end of the spring element, and an adjustment screw 96 extending through the lower side of the seat frame. Rotation of the adjustment screw (indicated by arrow 98) results in vertical movement of the clamp (indicated by arrow 100) and thus adjusts the distance between the forward end of the spring element and the lower inner surface of the seat frame. This allows adjustment of the biasing force provided by the spring element by adding to or reducing the pre-applied bending stress in the spring element.

The spring element 36*a* of FIGS. 6 and 7 includes a longitudinally curved lower surface 102, which acts as a cam. The cam surface diverges from the lower inner surface 46 of the seat frame 12 along its length. The initial point of contact of the curved surface with the lower tube surface functions as a fulcrum point $P_f$. It will be apparent that the bending length of the spring element, and hence its flexural resistance, will vary depending upon the distance of the fulcrum point $P_f$ from the point of contact $P_c$ with the upper inner surface of the backrest frame. Advantageously, because the lower surface of the spring element is curved, the location of the fulcrum point $P_f$ will move rearwardly (i.e. closer to the point of contact $P_c$ with the backrest frame) as the backrest frame is rotated backwardly and the spring element flexes, as shown in dashed lines in FIGS. 6 and 7. This rearward movement of the effective fulcrum point has the effect of reducing the bending length of the rearward portion of the spring element, thereby increasing its leverage and effective flexural resistance during rotation. Thus, the resistance to reclining increases as the degree of reclining increases. This can be desirable because more of the weight of a person's body is shifted to the backrest as the person reclines, and thus more resistance is required to provide the same support.

In another alternative embodiment, shown in FIG. 8, the flexural spring element 36*b* may have a constant cross-sectional shape. In this embodiment, the spring element is disposed such that its forward portion 82*b* is disposed near the upper inner surface 48 of the seat frame 12, and its rearward portion 84 abuts the upper inner surface of the backrest frame. The forward end is firmly held in a receiving slot 104 in a spring retainer 106 that is disposed (such as by a press fit) within the tubular seat frame. The spring retainer includes a hold-down wedge 108 above the end of the spring element 36*b*, for biasing the spring member in a slightly upward orientation so as to provide the pre-load force discussed above. The spring retainer also includes a cam surface 110 disposed below the spring element and toward the hinge 20 for supporting the spring element during bending, and for providing a rearwardly-moving fulcrum point, as discussed above.

Any of the various configurations of the spring elements shown in FIGS. 6–8 may be combined with any of the various limit stop configurations of FIGS. 3–5. One advantage of the embodiment of FIG. 5 is that the spring element 36 may be wider than that used with the embodiments of FIGS. 3 or 4. As noted above, the limit stop embodiments of FIGS. 3 and 4 include two vertically oriented stop plates disposed against each inner side of the tube, allowing the spring element to be disposed therebetween. Consequently, the spring element must be narrower than the inside of the tube by an amount at least equal to the sum of the thicknesses of the two stop plates. This condition is depicted in FIG. 9. Naturally, where the spring element is narrower, it will provide less flexural resistance than a wider spring element of the same material and same thickness. Additionally, with a narrower spring element, the stress imposed at the rearward bearing end of the spring element will be higher because the bearing surface is narrower.

By placing the limit stop outside of the tubular frame, the embodiment of FIG. 5 allows the full width of the tube to be occupied by the spring element 36. Thus a wider (and therefore stronger) spring element may be used. Additionally, a spring element having a constant cross-section is less expensive to manufacture and easier to install. This reduces the cost and complexity of fabrication of the chair. This configuration is also more durable. The inventors have found that a chair having a reclining mechanism that combines the features of FIG. 5 and FIG. 8 can be flexed and released several million cycles with no significant deterioration.

It will be apparent that the spring element 36, rather than being fixed within the seat frame tube 12 and extending into the backrest frame tube 14, may instead be fixed within the backrest frame tube and extend into the seat frame tube. Likewise, there are a variety of suitable methods of fixing an end of the spring element within one of the chair frame tubes other than those described above. For example, where the forward end 82 is disposed near the upper inner surface 48 of the seat frame, and the rearward end 84 also abuts the upper inner surface of the backrest frame, a wedge (not shown) may be used to maintain the spring element in contact with the upper inner surface of the seat frame, rather than the spring retainer 106 shown in FIG. 8. Likewise, a separate downwardly sloping cam surface (not shown), like that associated with the spring retainer, could be disposed adjacent the fixed pivot point, to support the spring element during bending, and for providing a rearwardly-moving fulcrum point, as discussed above.

Advantageously, because the backrest frame 14 is hingedly connected to the seat frame 12, failure of the spring element 36 in any of the embodiments disclosed herein will not cause the backrest frame to become detached from the seat frame. Rather, it will merely cause the backrest frame to flop backward and come to rest in the maximum backwardly reclined position. In this condition, the chair can be repaired by removing the backrest (i.e. disassembling the hinges 20), replacing the spring element, and reattaching the hinges.

Both the internal and external limit stop configurations disclosed above advantageously reduce and hide possible pinch points. With the external limit stop, fingers etc. cannot get between the stop surfaces because of the design of the stop member 74 and its corresponding slot 76 (See FIGS. 5, 10, 11). With the internal limit stop, the stop surfaces are enclosed within the tubular frame, and therefore are protected from objects entering therebetween. Because the stop plates are disposed against the sides of the tubular frame members, as depicted in FIG. 9, the stop plates themselves substantially prevent anything from being inserted into the gap between the tubes farther than the thickness of the tube walls themselves. Thus, in the unlikely event of a person getting their finger into that gap, any injury would be very minor, and would be limited to a pinch of the skin.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A chair, comprising:

a) a hollow tubular seat frame, having at least two spaced apart open ends;

b) a hollow tubular backrest frame, having a pair of spaced apart open ends aligned with and pivotally connected to the open ends of the seat frame at fixed pivot points;

c) a stop bar, having a back side disposed within one of the seat frame and the backrest frame;

d) a limit stop, disposed internally within at least one of the seat frame and backrest frame, having a stop surface, configured to abut the back side of the stop bar, to prevent rotation of the backrest frame relative to the seat frame beyond a maximum backwardly rotated position;

e) a substantially solid elongate spring element, extending from within each open end of the backrest frame into the corresponding open end of the seat frame, configured to bias the backrest frame in the upright position, and to resiliently resist backward rotation of the backrest frame;

f) a spring retainer, having a receiving slot, disposed within each open end of the hollow tubular seat frame, a forward end of he spring element being disposed within the receiving slot; and g) a cam surface, disposed below the spring element, configured to provide a rearwardly-moving fulcrum point for the spring element, so as to increase the effective flexural resistance of the spring element as the backrest is rotated backwardly.

2. A chair in accordance with claim 1, wherein the stop surfaces of the limit stop comprise an elongate slot, surrounding the stop bar, having a forward surface configured to abut a front side of the stop bar when the backrest frame is in the upright position, and a rearward surface configured to abut the back side of the stop bar when the backrest frame is in the maximum backwardly rotated position.

3. A chair in accordance with claim 1, wherein the spring element abuts a lower inner surface of the seat frame and an upper inner surface of the backrest frame.

4. A chair in accordance with claim 3, wherein the spring element further comprises a longitudinally curved lower surface producing a fulcrum point of contact of the spring element with the lower inner surface of the seat frame, the curved lower surface causing the effective position of the fulcrum point to move rearwardly as the backrest frame is rotated backwardly, thereby increasing the effective flexural resistance of the spring element during said rotation.

5. A chair in accordance with claim 3, further comprising a wedge disposed between the upper inner surface of the seat frame and the adjacent portion of the spring element, so as to maintain the spring element in contact with the lower inner surface of the seat frame.

6. A chair in accordance with claim 3, further comprising a hold-down assembly, disposed within the seat frame hollow member, and attached to an end of the spring element, configured to hold the spring element toward the lower inner surface of the seat frame.

7. A chair in accordance with claim 6, wherein the hold-down assembly includes an adjustment screw extending through a lower side of the seat frame hollow member, so as to allow adjustment of the biasing force provided by the spring element.

8. A chair in accordance with claim 3, further comprising an armrest assembly rigidly attached to the backrest frame.

9. A chair in accordance with claim 1, wherein the spring element abuts the upper inner surface of the seat frame and an upper inner surface of the backrest frame.

10. A chair in accordance with claim 9, further comprising a wedge disposed between the lower inner surface of the seat frame and the adjacent portion of the spring element, so as to maintain the spring element in contact with the upper inner surface of the seat frame.

11. A chair in accordance with claim 9, further comprising a downwardly sloping cam surface, disposed adjacent the fixed pivot point, configured to allow downward bending of the spring element during rotation of the backrest frame.

12. A chair in accordance with claim 1, wherein the spring element is formed of fiberglass resin.

13. A chair in accordance with claim 1, wherein the forward end of the spring element is press-fit into the receiving slot.

14. A chair in accordance with claim 1, wherein the spring retainer further comprises a hold down wedge, upward of the receiving slot, configured to bias the spring element in a slightly upward orientation.

15. A chair in accordance with claim 1, wherein the spring retainer further comprises:

a) a hold-down wedge, upward of the receiving slot; and b) a cam surface, disposed below the spring element, configured to provide a rearwardly-moving fulcrum point for the spring element, so as to increase the effective flexural resistance of the spring element as the backrest is rotated backwardly.

16. A chair in accordance with claim 1, wherein a forward portion of the spring element is disposed near an upper inner surface of the seat frame, and a rearward portion of the spring element abuts an upper inner surface of the backrest frame.

17. A chair, comprising:

a) a hollow tubular seat frame, having at least two spaced apart open ends;

b) a hollow tubular backrest frame, having a pair of spaced apart open ends aligned with and pivotally connected to the open ends of the seat frame at fixed pivot points;

c) a stop bar, having a back side disposed within one of the seat frame and the backrest frame;

d) a limit stop, disposed internally within at least one of the seat frame and backrest frame, having a stop surface, configured to abut the back side of the stop bar, to prevent rotation of the backrest frame relative to the seat frame beyond a maximum backwardly rotated position;

e) a substantially solid elongate spring element, extending from within each open end of the backrest frame into the corresponding open end of the seat frame, configured to bias the backrest frame in the upright position, and to resiliently resist backward rotation of the backrest frame;

f) a spring retainer, having a receiving slot, disposed within each open end of the hollow tubular seat frame, a forward end of he spring element being disposed within the receiving slot; and g) a hold down wedge, upward of the receiving slot, configured to bias the spring element in a slightly upward orientation.

18. A chair, comprising:

a) a hollow tubular seat frame, having at least two spaced apart open ends;

b) a hollow tubular backrest frame, having a pair of spaced apart open ends aligned with and pivotally connected to the open ends of the seat frame at fixed pivot points;

c) a stop bar, having a back side disposed within one of the seat frame and the backrest frame;

d) a limit stop, disposed internally within at least one of the seat frame and backrest frame, having a stop surface, configured to abut the back side of the stop bar, to prevent rotation of the backrest frame relative to the seat frame beyond a maximum backwardly rotated position;

e) a substantially solid elongate spring element, extending from within each open end of the backrest frame into the corresponding open end of the seat frame, configured to bias the backrest frame in the upright position, and to resiliently resist backward rotation of the backrest frame;

f) a spring retainer, having a receiving slot, disposed within each open end of the hollow tubular seat frame, a forward end of he spring element being disposed within the receiving slot; the spring retainer further comprising:

i) a hold-down wedge, upward of the receiving slot; and ii) a cam surface, disposed below the spring element, configured to provide a rearwardly-moving fulcrum point for the spring element, so as to increase the effective flexural resistance of the spring element as the backrest is rotated backwardly.

* * * * *